United States Patent [19]

Ikeda

[11] Patent Number: 4,790,038

[45] Date of Patent: Dec. 13, 1988

[54] BEDDING SPRING ASSEMBLY

[75] Inventor: Minoru Ikeda, Kokubunji, Japan

[73] Assignee: Leggett & Platt, Incorporated, Carthage, Mo.

[21] Appl. No.: 82,078

[22] Filed: Aug. 5, 1987

[51] Int. Cl.[4] ..... A47C 23/02

[52] U.S. Cl. ..... 5/247; 5/268; 5/271; 267/91; 267/95

[58] Field of Search ..... 5/256, 248, 268, 260, 5/271; 267/91, 95, 100, 103

[56] References Cited

U.S. PATENT DOCUMENTS

| | | | |
|---|---|---|---|
| 261,774 | 7/1882 | Singleton | 5/256 |
| 3,161,408 | 12/1964 | Molt | 267/91 X |
| 3,370,619 | 2/1968 | Docker . | |
| 3,472,290 | 10/1969 | Sykes et al. . | |
| 3,648,737 | 3/1972 | Dull . | |
| 3,657,749 | 4/1972 | Norman . | |
| 3,716,874 | 2/1973 | Thomas, Jr. | 5/256 X |
| 3,911,511 | 10/1975 | Higgins et al. . | |
| 4,003,563 | 1/1977 | Taylor | 5/248 X |
| 4,067,076 | 1/1978 | Krier . | |
| 4,112,726 | 9/1978 | Adams et al. . | |
| 4,156,442 | 5/1979 | Sykes . | |
| 4,160,544 | 7/1979 | Higgins | 5/248 X |
| 4,358,097 | 11/1982 | Zapletal et al. . | |
| 4,488,712 | 12/1984 | Higgins . | |
| 4,492,298 | 1/1985 | Zapletal et al. . | |
| 4,609,186 | 9/1986 | Thoenen | 5/248 X |
| 4,639,957 | 2/1987 | Wells et al. | 5/248 |
| 4,699,362 | 10/1987 | Krakauer | 267/91 |
| 4,703,527 | 11/1987 | Mizelle | 5/247 |
| 4,721,290 | 1/1988 | Hagemeister | 5/247 X |
| 4,730,358 | 3/1988 | Zapletal | 5/247 |

FOREIGN PATENT DOCUMENTS

| | | |
|---|---|---|
| 58-54244 | 3/1983 | Japan . |
| 386251 | 1/1933 | United Kingdom . |

*Primary Examiner*—Ramon O. Ramirez

*Attorney, Agent, or Firm*—Wood, Herron & Evans

[57] ABSTRACT

A bedding or seating spring product comprising a spring assembly having multiple rows of coil springs wherein each row of coil springs is made from a single continuous length of wire and wherein each row contains a plurality of coils interconnected by interconnecting segments, alternate ones of which are disposed in the top and bottom planes of the spring assembly. The interconnecting segments are generally planar and include U-shaped portions having parallel legs and a connecting web. Adjacent rows of coils are connected by securement of the web of a U-shaped portion of each interconnecting segment of one row of coils to a pair of spaced portions of interconnecting segments of an adjacent row.

17 Claims, 4 Drawing Sheets

BEDDING SPRING ASSEMBLY

This invention relates to spring assemblies, and more particularly, to a spring assembly of the type commonly used in bedding or seating products.

Bedding products, such as mattresses or box springs, have traditionally been formed by interconnecting a plurality of coil-shaped springs into a flat structure. That flat structure has commonly been covered with a mat of padding or urethane foam covering or the like, and the complete assembly, including the coil springs and padding, encased within an upholstered covering. A coil spring product constructed in this manner requires a great number of independent coil springs to be arranged in a matrix with the upper and lower end faces of the coil springs connected, commonly by helical lacing wires, to form interconnected rows and columns of such springs. Such spring systems are time consuming to assemble and/or require complex, expensive machinery for making the assembly.

In an effort to reduce the time and expense associated with assembly of coil spring products and to reduce the cost of wire employed in such spring products, there has been developed spring assemblies wherein each row of coils of the multiple row product is formed from a single continuous length of wire. Each row includes a plurality of helical coil sections having substantially parallel axes and connected by interconnecting segments of the wire. The interconnecting segments alternately connect the upper and lower ends of each coil to the adjacent helical coils of the row. Typically, the rows of coils are interconnected by helical lacing wires. Examples of such prior art spring assemblies may be found in U.S. Pat. Nos. 3,657,749, 3,911,511 and 4,358,097, as well as in published Japanese patent application No. 56-149789.

In prior art spring assemblies of the type described hereinabove wherein rows of coil springs are formed from a single continuous length of wire and wherein the individual rows of coils are connected by helical lacing wires, the coil portions and the interconnecting segment portions of multiple rows of each spring assembly cannot easily be deformed elastically as a body or as a unit when a load is applied to the upper surface of the spring assembly. Consequently, the upper surface of the spring assembly may compress unevenly and suffer undulation which tends to spoil the cushioning capability of the assembly.

It has therefore been an objective of this invention to provide an improved spring assembly in which the coil spring portions and the interconnecting segment portions of adjacent spring rows can be deformed elastically as a body or as a unit when a vertical load is applied to the top surface of the spring assembly with the result that the spring assembly has an improved cushioning capability.

In order to achieve this objective, the invention of this application is so constructed that a plurality of rows of spring coils are arranged side by side with the coil springs of each row having parallel axes and with the coil springs of each row interconnected by interconnecting segments connecting the upper and lower ends of adjacent coil springs and with the interconnecting segments of each coil spring being generally U-shaped with a pair of parallel legs and a connecting web forming the U-shaped interconnecting segment. Each web portion of the U-shaped interconnecting segment is connected to a portion of an interconnecting segment of an adjacent row of coil springs by means of a helical lacing wire or other connector so as to create an assembled spring assembly wherein the adjacent rows of coils are interconnecting and may be deformed elastically as a body or as a unit when they are subjected to a vertical load. In one preferred embodiment of this invention, the web section of the U-shaped portion of the interconnecting segment is connected to a pair of spaced, straight portions of the interconnecting segment of an adjacent row of coils. In another embodiment of the invention, the web section of the U-shaped portion of the interconnecting segment is connected to a pair of curved portions of the interconnecting segments of an adjacent row of coils. In yet another embodiment of the invention, the web section of the U-shaped portion of the interconnecting segment of a row of coil springs is connected to a slightly curved, but almost straight, pair of spaced portions of the interconnecting segment of an adjacent row of coils.

This objective and the advantages of the invention of this application will be more clearly understood with reference to the drawings in which.

Figure 1:
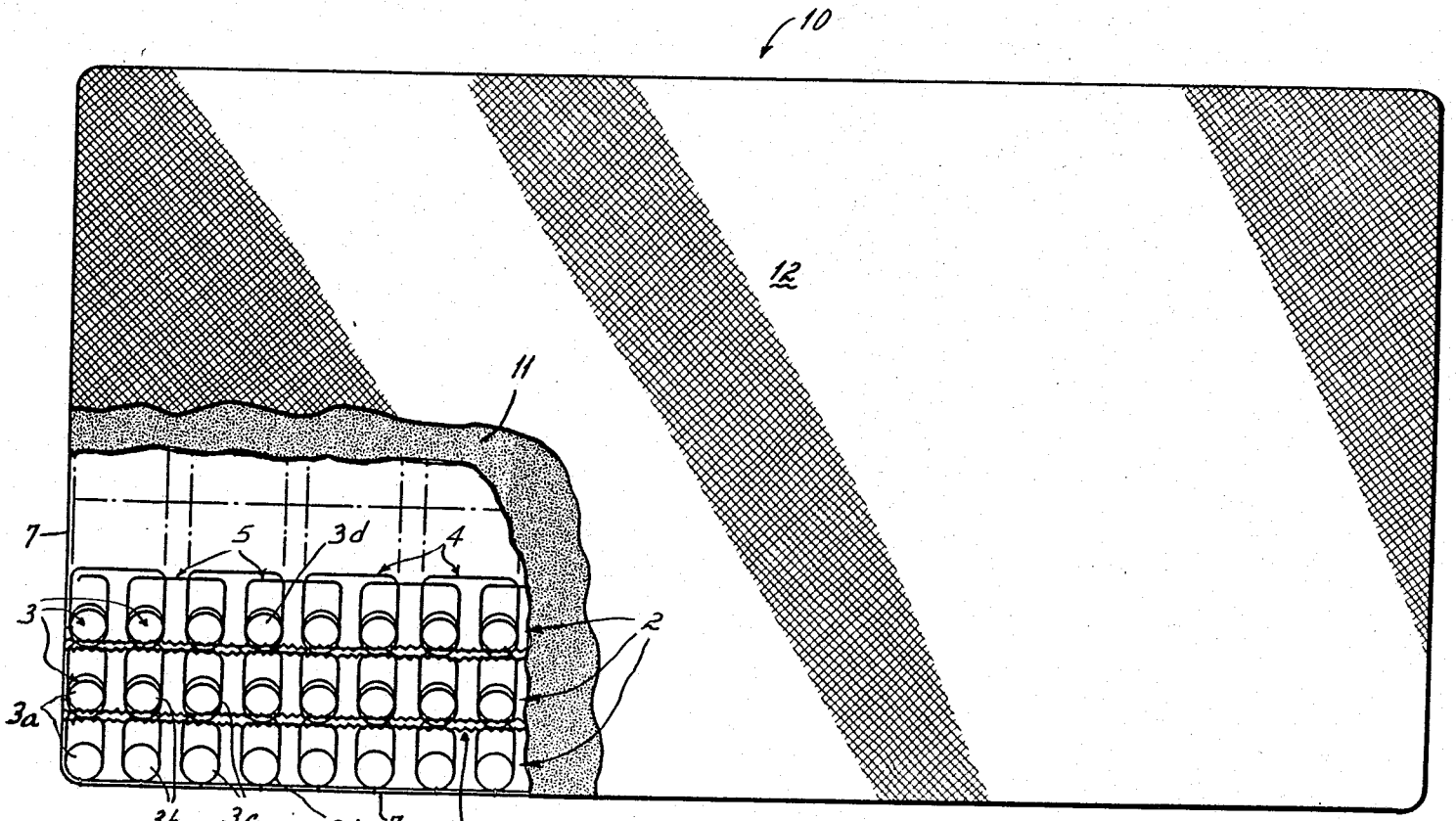
FIG. 1 is a top plan view of a mattress incorporating the invention of this application.
Figure 2:
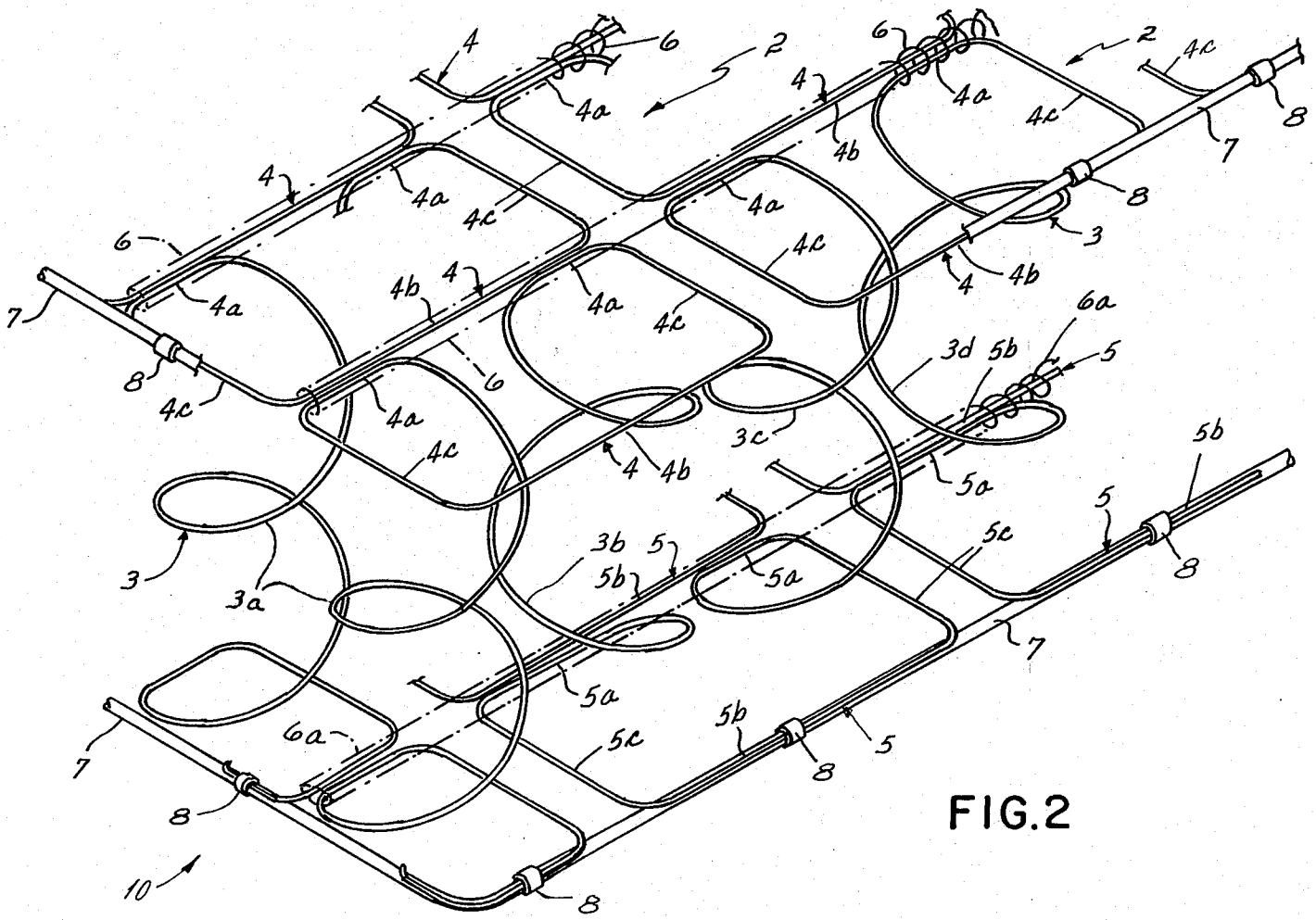
FIG. 2 is an enlarged perspective view of a corner portion of the spring assembly portion of the mattress of FIG. 1.

The mattress 1 or spring product illustrated in FIGS. 1 and 2 comprises a spring assembly 10 over the top surface of which there is padding material 11, such as urethane foam. The spring assembly 10 and padding material 11 are encased in an upholstered covering 12.

The spring assembly 10 comprises a plurality of rows 2 of coil springs 3 extending longitudinally along the full length of the assembly 10. Each row 2 of coil springs 3 includes a plurality of helical coils **3*a*, 3*b*, 3*c* . . . , whose axes extend substantially parallel to one another. Each helical coil terminates in an upper and lower interconnecting segment 4 and 5, respectively, connecting the upper and lower ends of adjacent coils 3*a*, 3*b*, 3*c*. . . . All of the coils 3*a*, 3*b*, 3*c*. . . , of each row, as well as the interconnecting segments 4 and 5** of each row of coils, are formed from a single, continuous length of wire.

Each row 2 of coils 3 comprises a first helical portion or coil **3*a* connected at its upper terminal end to a substantially U-shaped upper interconnecting segment 4 so that one end of the interconnecting segment 4 is continuous with the terminal end of the coil 3*a*. The opposite end of the interconnecting segment 4 is connected to the upper terminal end of a second helix or helical coil 3*b* whose axis extends parallel to that of the first helical portion or coil 3*a***.

The upper interconnecting segment 4 is planar and located in a horizontal plane. It includes a pair of first straight portions **4*a*, a second straight portion or section 4*b*, and a pair of parallel straight sections 4*c* which extend between the first straight portions 4*a* and the second straight portion 4*b*. Together, the pair of parallel, straight sections 4*c* and the second straight portion 4*b*** form a generally U-shaped portion of the planar interconnecting segment 4. This U-shaped portion has a pair of parallel legs 4c and a connecting web 4b. Each first straight portion 4a of an interconnecting segment 4 has one end connected to the upper end of a helical coil 3a, 3b. Each straight portion 4a of the interconnecting segment 4 is located on one side of the row 2 of coils 3 with respect to the longitudinal direction of the row 2 of coil springs. The second straight portion or section 4b (web of the U-shaped portion) is spaced from the first straight portions 4a, extending horizontally and parallel thereto, and is situated on the other side of the row 2 of spring coils from the straight portions 4a.

Each lower interconnecting segment 5 of the row 2 of coil springs is connected to the lower terminal end of a pair of coils 3b, 3c . . . , so that each interconnecting segment 5 is continuous with and forms a continuation of the row of coils. Each interconnecting segment 5 extends away from and is connected to adjacent coils or a pair of coils 3a, 3b which are connected at the top by an interconnecting segment 4.

Like the upper interconnecting segment 4, the lower interconnecting segment 5 includes a pair of first straight portions 5a, a second straight portion 5b spaced from the first straight portions 5a and extending horizontally and parallel thereto, and parallel legs 5c extending perpendicular to and between the parallel first straight portions 5a and second straight portion 5b of each interconnecting segment 5. The parallel legs 5c and the second straight portion 5b of the interconnecting segment 5 together form a generally U-shaped portion of the interconnecting segment 5.

By repeatedly forming helical or coil sections 3a, 3b, 3c . . . , and upper and lower interconnecting segments 4 and 5 in succession, straight continuous rows of coil springs are formed from a continuous wire, which continuous wire has multiple coils 3a, 3b, 3c . . . , with substantially parallel axes and interconnecting segments 4 and 5 which alternately connect the top and bottom ends of the coils to the adjacent coils.

Rows of coils formed in this manner are arranged side by side as shown in FIG. 1. First straight portions 4a of upper interconnecting segments 4 of each row 2 of springs are connected by means of helical lacing wires 6 to second straight portions 4b of upper interconnecting segments 4 of rows 2 of springs adjacent thereto. Similarly, first straight portions 5a of lower interconnecting segments 5 of each row of springs are connected by means of helical wires 6a to second straight portions 5b of lower interconnecting segments 5 of the row of coil springs adjacent thereto.

A border wire 7 is connected by means of conventional metal clips 8 to the peripheral edge portion of each of the top and bottom faces of a spring assembly 10 which is composed of the rows 2 of springs coupled to one another. This spring assembly 10 is covered with a conventional fabric batting or cover of urethane foam 11 or the like which is then encased within a conventional upholstered covering 12.

In FIG. 1 and for clarity of the drawing, the upper and lower interconnecting segments 4 and 5 are shown as being different in width (vertically offset one from the other) with respect to the length of each row 2 of coil springs. In most instances, though, the interconnecting segments 4 and 5 will be of the same width so that the helical lacing wires 6, 6a will overlie on another in the same vertical planes.

It will now be understood that the first straight portions 4a and 5a and the second straight portions 4b and 5b of each interconnecting segment are spaced on opposite sides of each coil spring of a row of coil springs. If a load is applied to the upper surface of a spring assembly 10, therefore, the coil portions 3a, 3b, 3c . . . , of each row of coils and the upper interconnecting segments 4 of each row of springs are displaced in a body and cannot be tilted in the transverse direction. In other words, the whole upper surface of a spring assembly 10 is displaced elastically to a relatively substantially uniform degree, so that it is prevented from tilting or becoming undulating.

Figure 3:
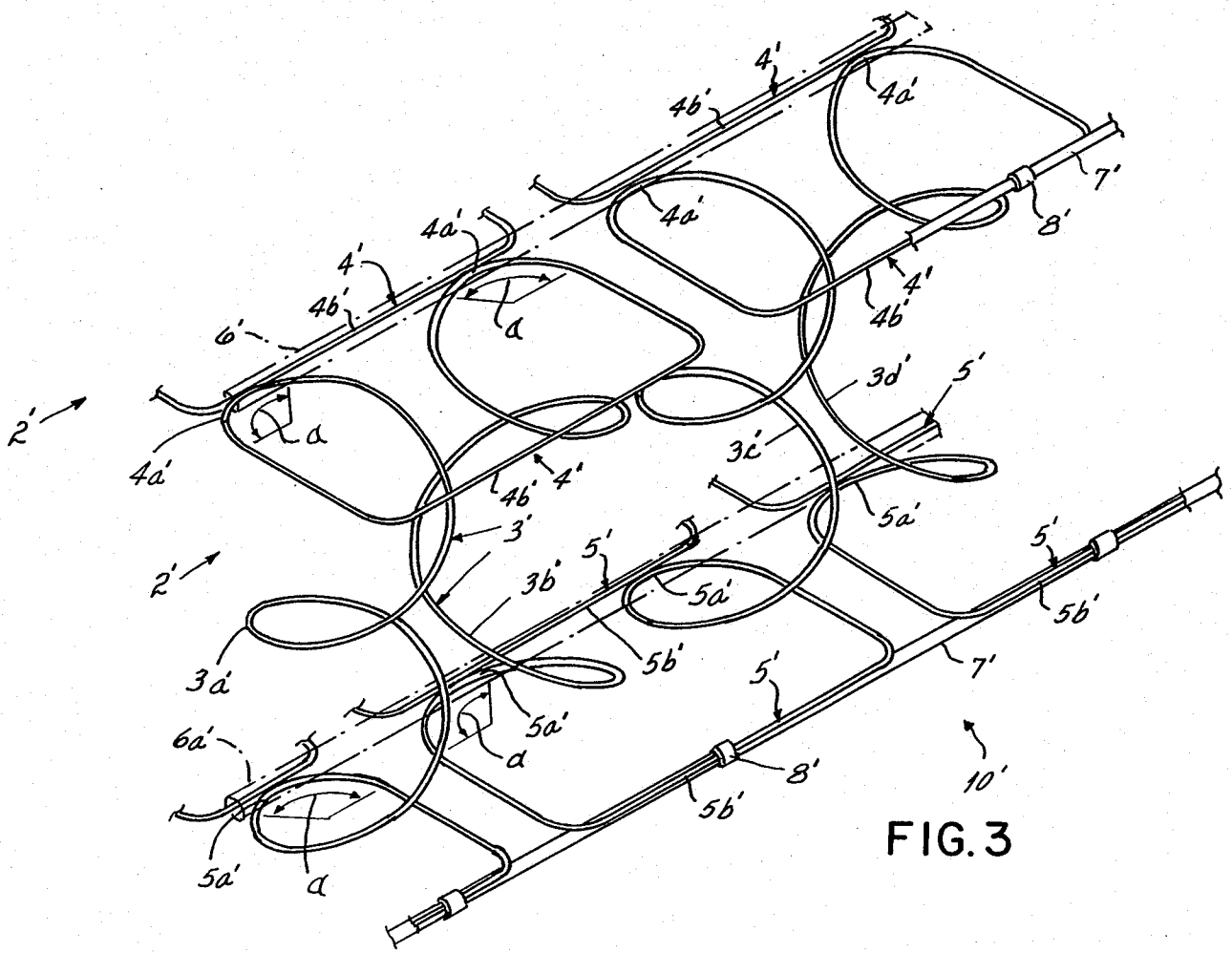
FIG. 3 is a perspective view, similar to FIG. 2, illustrating an alternative modification for a mattress embodying the invention of this application.

With reference now to FIG. 3, there is illustrated a modified spring 10' for a mattress incorporating the invention of this application. In this modification, those portions of the spring which are identical to the embodiment of FIGS. 1 and 2 have been given similar numerals. This modification differs from the modification of FIGS. 1 and 2 only in that the top and bottom of each coil 3a, 3b, 3c . . . , of the rows of coils are connected to the U-shaped portions of the interconnecting segments 4', 5' by means of a pair of spaced arcuate portions 4a', 5a', respectively, rather than by straight portions 4a, 5a, respectively. These arcuate portions 4a', 5a' are located in the same horizontal planes as the U-shaped portions of the interconnecting segments 4', 5'. The arcuate portions 4a', 5a' extend through an arc "a" of approximately 120°.

As in the first embodiment of FIGS. 1 and 2, a pair of spaced arcuate sections 4a' of each interconnecting segment 4' are connected to the straight portion 4b' of an interconnecting segment 4' of an adjacent row of coils by means of a helical lacing wire 6'. Similarly, a pair of arcuate sections 5a' of each row of coils are connected to a straight portion 5b' of an adjacent row of coils by a helical lacing wire 6a'. In all other respects, the embodiment of FIG. 3 is identical to the embodiment of FIGS. 1 and 2.

Figure 4:
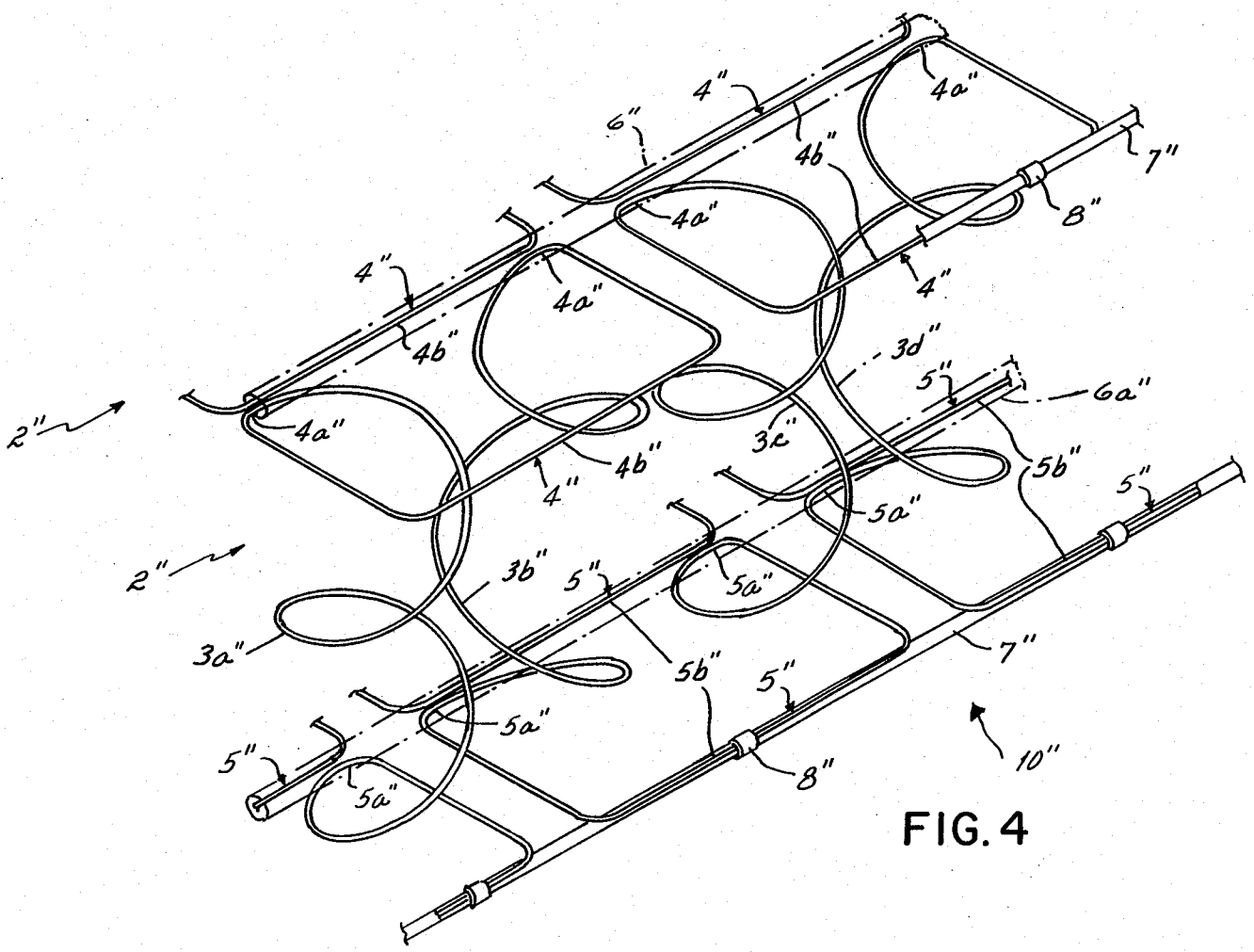
FIG. 4 is a perspective view, similar to FIG. 3, illustrating a second alternative modification for a mattress embodying the invention of this application.

With reference now to FIG. 4, there is illustrated yet another embodiment 10" of a spring assembly which may be utilized in the mattress of FIGS. 1 and 2. In this embodiment, the rows of coil springs 2" differ from the rows 2 of coils of FIGS. 1 and 2 in that the spaced portions of each interconnecting segment 4" which connect the tops of adjacent coils of a row to the U-shaped portion of the interconnecting segment are slightly arcuate, rather than straight, as in the embodiment of FIGS. 1 and 2. As in the first embodiment, these slightly arcuate portions 4a" of a row 2" of coils are laced by a helical lacing wire 6" to a straight portion 4b" of an adjacent row of coils so as to assemble adjacent rows of coils 2" to one another. Similarly, the bottoms or lower ends of each coil 3a", 3b", 3c" . . . , are connected by slightly arcuate portions 5a" to the U-shaped portion of the interconnecting segment 5". These slightly arcuate portions 5a" are laced to the straight portions 5b" of an adjacent row of coils by means of helical lacing wires 6a". When assembled, and laced together, the rows of coil springs 2" may be utilized in a spring assembly 10" in place of the interconnected rows of coils 2 of the embodiment illustrated in FIGS. 1 and 2.

While I have described only three different embodiments of my invention, persons skilled in this art will appreciate changes and modifications which may be made without departing from the spirit of my invention. Therefore, I do not intend to be limited except by the scope of the following appended claims:

I claim:

1. A bedding mattress comprising a spring assembly having an upper and a lower planar surface, said assembly comprising a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, said interconnecting segments including U-shaped portions having two parallel leg sections connected by a web section, said web section of each U-shaped portion of each row being overlapped relative to a pair of selected portions of interconnecting segments of an adjacent row, helical spring means extending parallel to said rows for the length of said rows, said helical spring means being wound around said overlapped portions so as to secure said rows of coils in an assembled relation, a covering material over at least the top surface of said spring assembly, and an upholstered covering material encasing said spring assembly and said covering material.

2. A spring assembly having an upper and a lower planar surface, said assembly comprising a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicularly to the upper and lower surfaces of said spring assembly, said interconnecting segments including U-shaped portions having two parallel leg sections connected by a web section, said web section of each U-shaped portion of each row being overlapped relative to a pair of selected portions of interconnecting segments of an adjacent row, and helical spring means extending parallel to said rows for the length of said rows, said helical spring means being wound around said overlapped portions so as to secure said rows of coils in an assembled relation.

3. The spring assembly of claim 2 wherein said overlapped pair of selected portions of interconnecting segments comprises curved sections of said interconnecting segments.

4. The spring assembly of claim 2 wherein said overlapped pair of selected portions of interconnecting segments comprises a pair of colinearly aligned, spaced straight portions, said pair of straight portions being spaced from but parallel to said web sections.

5. A spring assembly having an upper and a lower planar surface, said assembly comprising:

a plurality of rows of coils, each of said rows being formed from a single, continuous length of wire, and each of said rows containing a plurality of coils interconnected by substantially interconnecting segments, each of said interconnecting segments including a U-shaped portion, alternate ones of said interconnecting segments being disposed in the planes of the upper and lower surfaces of said spring assembly, the axes of said coils being disposed perpendicular to the upper and lower surfaces of said spring assembly, each of said U-shaped portions of said interconnecting segments including two parallel leg sections interconnected by a web section, said web section of each of said U-shaped portions of said interconnecting segments of each row being overlapped relative to selected portions of interconnecting segments of an adjacent row, and helical spring means extending parallel to said rows for the length of said rows, said helical spring means being wound around said overlapped, straight web sections and selected portions of interconnecting segments so as to secure said rows of coils in an assembled relation.

6. The spring assembly of claim 5 wherein said overlapped selected portions of interconnecting segments comprises curved sections of said interconnecting segments.

7. The spring assembly of claim 5 wherein said overlapped selected portions of interconnecting segments comprises a pair of colinearly aligned, spaced straight portions, said pair of straight portions being spaced from but parallel to said web sections.

8. A spring assembly having an upper and a lower planar surface, said assembly comprising:

a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, said interconnecting segments including U-shaped portions, said U-shaped portions of each interconnecting segment of each row being overlapped relative to selected portions of interconnecting segments of an adjacent row, and helical spring means extending parallel to said rows for the length of said rows, said helical spring means being wound around said overlapped portions so as to secure said rows of coils in an assembled relation.

9. The spring assembly of claim 8 wherein each of said interconnecting segments comprises a pair of first straight portion, one each of which is continuous with and connected to one end of a coil, and a second straight portion spaced from the first straight portions, said second straight portion being spaced from, but substantially parallel to, the first straight portions, said first straight portions of each interconnecting segment being overlapped relative to the second straight portion of a row of coils adjacent thereto.

10. The spring assembly of claim 8 wherein a straight portion of each of said U-shaped interconnecting segments is overlapped relative to a curved end portion of one of said coils and is connected thereto by said helical spring means.

11. A spring assembly having an upper and a lower planar surface, said assembly comprising:

a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, each of said interconnecting segments comprising a pair of first straight portions, each of which is continuous with and connected to one end of a coil, and a second straight portion spaced from the first straight portions, said second straight portions being spaced from but substantially parallel to the first straight portions, said first straight portions of each interconnecting segment being overlapped relative to the second straight portion of a row of coils adjacent thereto, and helical spring means extending parallel to said rows for the length of said rows, said helical spring means being wound around said overlapped portions so as to secure said rows of coils in an assembled relation.

12. A spring assembly having an upper and a lower planar surface, said assembly comprising a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, said interconnecting segments including U-shaped portions having two parallel leg sections connected by a web section, said web section of each U-shaped portion of each row being overlapped relative to selected portions of interconnecting segments of an adjacent row, and means connecting said overlapped portions so as to secure said rows of coils in an assembled relation.

13. The spring assembly of claim 12 wherein said overlapped selected portions of interconnecting segments comprises curves sections of said interconnecting segments.

14. The spring assembly of claim 12 wherein said overlapped selected portions of interconnecting segments comprises a pair of colinearly aligned, spaced straight portions, said pair of straight portions being spaced from but parallel to said web sections.

15. A spring assembly having an upper and a lower planar surface, said assembly comprising:

a plurality of rows of coils, each of said rows being formed from a single, continuous length of wire, and each of said rows containing a plurality of coils interconnected by substantially interconnecting segments, each of said interconnecting segments including a U-shaped portion, alternate ones of said interconnecting segments being disposed in the planes of the upper and lower surfaces of said spring assembly, the axes of said coils being disposed perpendicular to the upper and lower surfaces of said spring assembly, each of said U-shaped portions of said interconnecting segments including two parallel leg sections interconnected by a web section, said web section of each of said U-shaped portions of said interconnecting segments of each row being overlapped relative to selected portions of interconnecting segments of an adjacent row, and means connecting said overlapped, straight web sections and selected portions of interconnecting segments so as to secure said rows of coils in an assembled relation.

16. A spring assembly having an upper and a lower planar surface, said assembly comprising:

a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, said interconnecting segments including U-shaped portions, said U-shaped portions of each interconnecting segment of each row being overlapped relative to selected portions of interconnecting segments of an adjacent row, and means connecting said overlapped portions so as to secure said rows of coils in an assembled relation.

17. A spring assembly having an upper and a lower planar surface, said assembly comprising:

a plurality of rows of coils, each of said rows being formed from a single, continuous length of wire, and each of said rows containing a plurality of coils interconnected by substantially planar interconnecting segments, alternate ones of said interconnecting segments being disposed in the planes of the upper and lower surfaces of said spring assembly, portions of said interconnecting segments extending beyond the periphery of said coils, the axes of said coils being disposed perpendicular to the upper and lower surfaces of said spring assembly, each of said interconnecting segments comprising a pair of first straight portions, each of which is continuous with and connected to one end of a coil, and a second straight portion spaced from the first straight portions, said second straight portions being spaced from but substantially parallel to the first straight portions, said first straight portions of each interconnecting segment being overlapped relative to the second straight portion of a row of coils adjacent thereto, and means connecting said overlapped portions so as to secure said rows of coils in an assembled relation.

* * * * *